US007658018B2

(12) United States Patent
Lin et al.

(10) Patent No.: US 7,658,018 B2
(45) Date of Patent: Feb. 9, 2010

(54) INSOLE WITH VENTILATION

(75) Inventors: Hsi-Liang Lin, 3F, No.23, Alley 5, Lane 423, Sec 5, Chung Hsiao East Rd., Taipei (TW); Ming-Hsiung Lin, 3F, No. 23, Alley 5, Lane 423, Sec. 5, Chung Hsiao East Rd., Taipei (TW)

(73) Assignees: Chao-Yung Chan, Taipei (TW); Ming-Hsiung Lin, Taipei (TW); Hsi-Liang Lin, Taipei (TW)

( * ) Notice: Subject to any disclaimer, the term of this patent is extended or adjusted under 35 U.S.C. 154(b) by 474 days.

(21) Appl. No.: 11/755,742

(22) Filed: May 31, 2007

(65) Prior Publication Data

US 2008/0295358 A1 Dec. 4, 2008

(51) Int. Cl.
*A43B 13/38* (2006.01)
*A43B 7/06* (2006.01)

(52) U.S. Cl. ..... 36/43; 36/3 B

(58) Field of Classification Search ..... 36/43, 36/44, 3 B, 141

See application file for complete search history.

(56) References Cited

U.S. PATENT DOCUMENTS

| | | | | |
|---|---|---|---|---|
| 3,624,930 | A * | 12/1971 | Johnson et al. | 36/43 |
| 6,199,304 | B1 * | 3/2001 | Ludemann | 36/44 |
| 6,318,002 | B1 * | 11/2001 | Ou | 36/44 |
| 6,425,194 | B1 * | 7/2002 | Brie | 36/43 |
| 6,681,501 | B1 * | 1/2004 | Polifroni | 36/3 B |
| 7,434,338 | B2 * | 10/2008 | Pfander | 36/28 |
| 2009/0056171 | A1 * | 3/2009 | Lin | 36/3 B |

* cited by examiner

*Primary Examiner*—Ted Kavanaugh
(74) *Attorney, Agent, or Firm*—Leong C. Lei

(57) ABSTRACT

The insole has a number of flexible bulges on a first major surface, and a number of protruding ribs on a second major surface. The projections of the bulges fall within the regions bounded by the ribs. The bulges and their underlying bounding ribs therefore form a number of chambers. The insole further contains a number of through holes positioned between the ends of at least two ribs. The insole further contains a larger heel bulge provided on the first major surface in the heel section, and a concave on the second major surface, which is conducted to the other chambers via at least a duct.

4 Claims, 3 Drawing Sheets

INSOLE WITH VENTILATION

CROSS-REFERENCE

This application is related to the co-pending patent application Ser. No. 11/627,988, owned by the same applicants.

(a) Technical Field of the Invention

The present invention generally relates to insoles of footwear, and more particularly to an insole having an integrated ventilation means.

(b) Description of the Prior Art

Enhanced ventilation is a major research focus in the footwear industry recently. Most of the teachings provides air vents in the midsole or outsole, or embeds air bags inside the midsole or outsole, so as to draw outside cool and dry air into the shoes when the user walks.

These teachings suffer the following disadvantages. First, the ventilation mechanism is an integral part of the midsole or outsole. Therefore, if a shoe is broken or damaged, the ventilation mechanism is discarded along with the broken shoe, which is obviously not economic. Also, as the ventilation mechanism is an integral part of the shoe, the ventilation mechanism has to be re-designed for each style of shoes. The production cost is inevitably increased. Thirdly, a shoe not designed with the ventilation in the first place cannot be improved later to include such function.

In Republic of China, Taiwan, Patent Application Serial No. 094222027, the present inventor provides an insole having an air bag embedded in the heel section (i.e., the part of the insole where the heel would rest). The air bag periodically blows air into the shoe as the user walks and stamps on the air bag. Despite its effectiveness, the air bag has to be produced separately and glued to the insole manually. Both the production cost and labor therefore cannot be effectively reduced.

The teaching also provides a number of bulges on a major surface of the insole and a number of protruding ribs on the other major surface. Each bulge is positioned corresponding to an intersection of the ribs. The teaching, however, suffers that the bulges are rather limited in size and therefore can only produce limited air flow. The ventilation effect still has significant room for improvement.

SUMMARY OF THE INVENTION

Accordingly, a novel insole is provided herein to obviate the foregoing shortcomings of prior arts.

The insole has a number of bulges on a first major surface, and a number of protruding ribs on a second major surface. The projections of the bulges fall within the regions bounded by the ribs. A bulge and its underlying bounding ribs therefore form a chamber. The insole further contains a number of through holes positioned between the ends of at least two adjacent ribs (e.g., at the "intersections" where four ribs meet with each other).

The insole further contains a larger heel bulge provided on the first major surface in the heel section, and the heel section on the second major surface is concaved to form a heel chamber, which is conducted to the other chambers via at least a duct.

When a user lands his/her shoe on the ground, the bulges are pressed to drive the air inside their corresponding chambers to flow through the adjacent through holes upward into the shoe. When the user lifts the shoe above the ground, the bulges return to its normal bulging state by the resilience. The outside cool and dry air is thereby drawn into the chambers. The foregoing process repeats itself periodically as the user walks.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
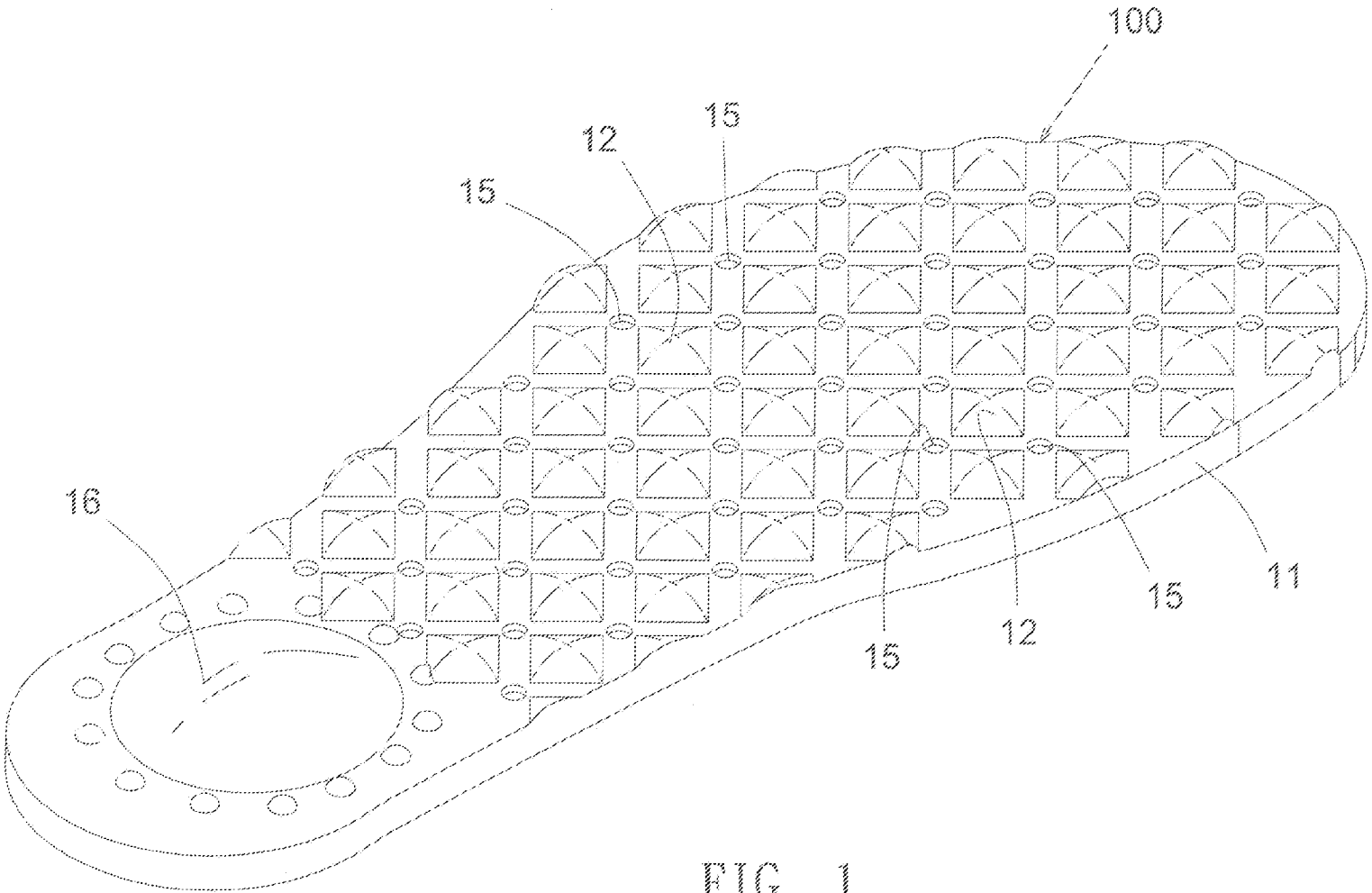
FIG. 1 is a perspective view showing a major surface of an insole according to an embodiment of the present invention.
Figure 2:
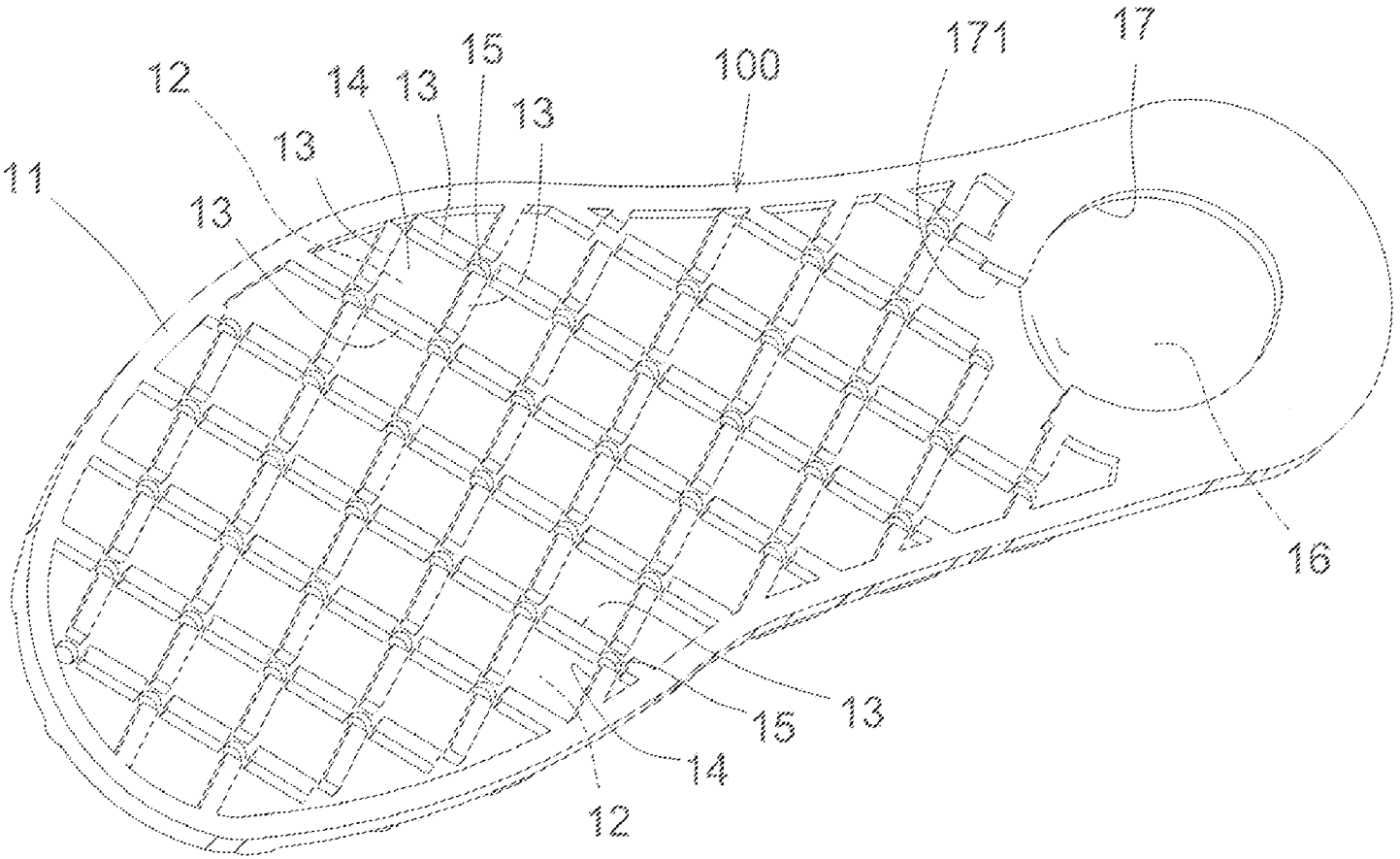
FIG. 2 is a perspective view showing the other major surface of the insole of FIG. 1.
Figure 3:
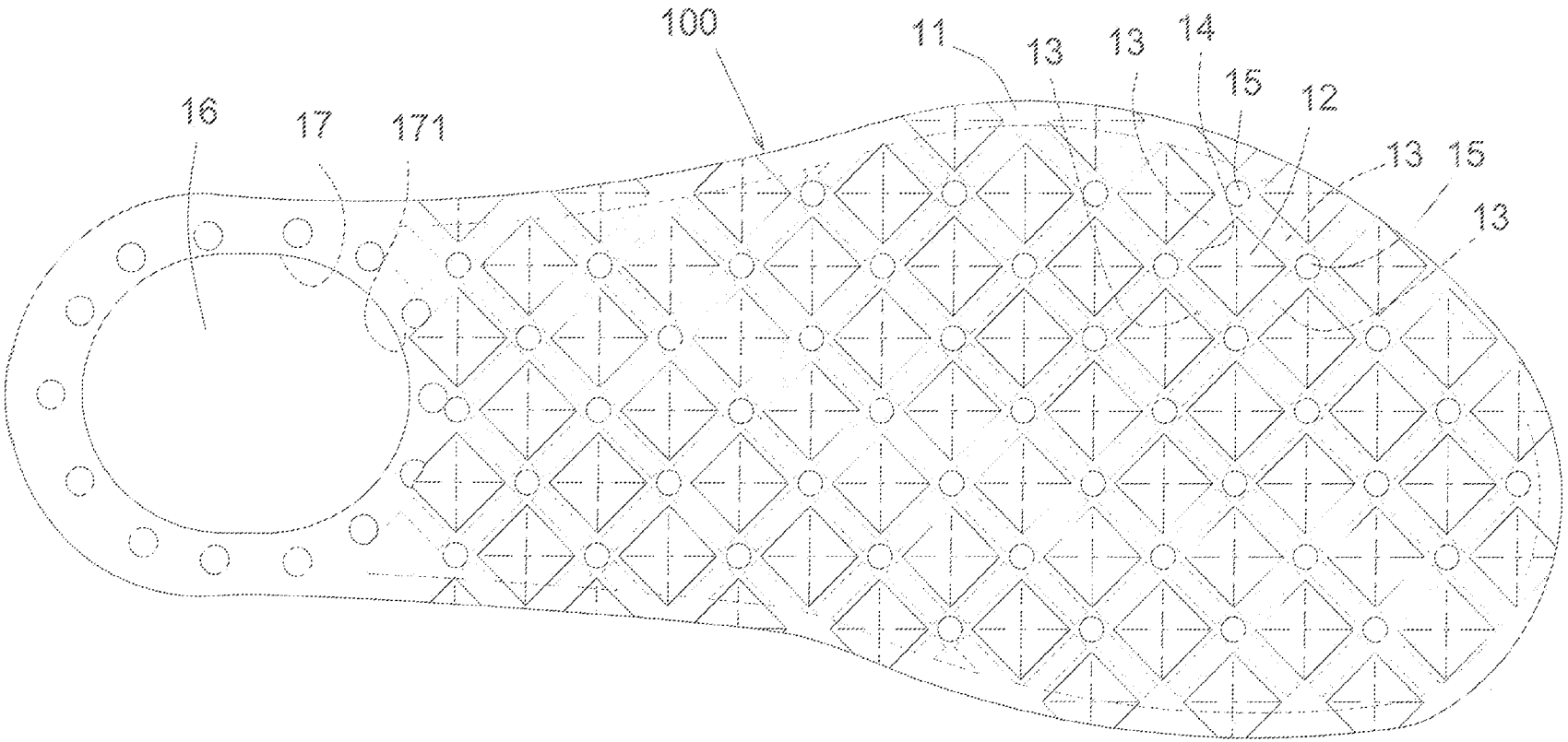
FIG. 3 is at op view showing the insole of FIG. 1.

As shown in FIGS. 1 to 3, an insole 100 according to an embodiment of the present invention mainly contains a body 11. A number of flexible bulges 12 are provided on a first major surface of the body 11. On the other hand, a number of protruding ribs 13 are provided and arranged into a mesh on the other (i.e., second) major surface of the body 11. The bulges 12 and the ribs 13 are configured such that the projections of the bulges 12 fall within the regions bounded by the ribs 13. A bulge 12 and its corresponding and underlying bounding ribs 13 therefore form a chamber 14. The body 11 further contains a number of through holes 15 positioned between the ends of at least two adjacent ribs 13 (e.g., at the "intersections" where four ribs 13 meet with each other in the present embodiment). Please note that the ribs 13 do not contact with each other and, therefore, the holes 15 and their adjacent chambers 14 are conducted.

The body 11 further contains a larger heel bulge 16 provided on the first major surface in the heel section. On the other hand, the heel section on the second major surface is concaved to form a heel chamber 17. The projection of the heel bulge 16 falls within the heel chamber 17. The heel chamber 17 is conducted to the chambers 14 via at least a horn-shaped duct 171. The duct 171 is an opening to the heel chamber 17 and can have other appropriate shape.

Please note that the bulges 12 and the heel bulges 16 can have a spherical shape or other appropriate shape.

When a user walks with a shoe having the insole 100 installed and lands his/her shoe on the ground, the bulges 12 and 16 are pressed to drive the air inside their corresponding chambers 14 and 17 to flow through the adjacent holes 15 upward into the shoe. When the user lifts the shoe above the ground and releases the pressure on the bulges 12 and 16, the bulges 12 and 16 return to their normal bulging state from the pressed state by resilience. The outside cool and dry air is thereby drawn into the chambers 14 and 17. The foregoing process repeats itself periodically as the user walks and the shoe is therefore thoroughly ventilated.

From the foregoing description, it can be understood that, as the through holes 15 are arranged around the bulges 12, the bulges 12 and their corresponding chambers 14 are larger compared to the prior arts. As such, a larger amount of air is drawn into and expelled from the chambers 14, and a superior ventilation effect is thereby achieved.

The insole 100 can be placed inside and used along with any type of shoes. In addition, the insole 100 can also be implemented as an integral part of any type of shoes.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An insole with ventilation, comprising:

a plurality of flexible bulges on a first major surface of said insole;

a plurality of protruding ribs on the other, second major surface of said insole; and a plurality of through holes around said bulges conducting said first and second major surfaces;

wherein the projections of a bulge falls within the region bounded by said ribs, respectively; a plurality of chambers are formed by said bulges and their corresponding bounding ribs; and said chambers are conducted to adjacent through holes.

2. The insole according to claim 1, further comprising a heel bulge in the heel section on said first major surface; and a concave in the heel section on said second major surface;

wherein the projection of said heel bulge falls within said concave; and said concave is conducted to said chambers via at least a duct.

3. The insole according to claim 2, wherein said duct has a horn shape.

4. The insole according to claim 1, wherein said through holes are positioned between the ends of at least two adjacent ribs.

* * * * *